US008366111B2

(12) United States Patent
Factor

(10) Patent No.: US 8,366,111 B2
(45) Date of Patent: Feb. 5, 2013

(54) TILE TO GAME CARD REPLICATION GAME

(76) Inventor: Nancy Factor, Boca Raton, FL (US)

( * ) Notice: Subject to any disclaimer, the term of this patent is extended or adjusted under 35 U.S.C. 154(b) by 213 days.

(21) Appl. No.: 12/820,792

(22) Filed: Jun. 22, 2010

(65) Prior Publication Data

US 2010/0259006 A1 Oct. 14, 2010

Related U.S. Application Data

(63) Continuation-in-part of application No. 12/286,405, filed on Sep. 29, 2008.

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS 3,309,092 A * 3/1967 Hardesty et al. ..... 273/248
3,901,513 A * 8/1975 Spohn ..... 273/236
4,147,363 A * 4/1979 Lee et al. ..... 273/304
4,236,720 A * 12/1980 Belony ..... 273/292
5,419,004 A * 5/1995 Fox ..... 15/236.01
5,586,764 A * 12/1996 Katz ..... 273/293
5,628,514 A * 5/1997 Nguyen et al. ..... 273/292
5,632,487 A * 5/1997 Nguyen ..... 273/292
6,003,869 A * 12/1999 Kuo ..... 273/292
6,050,569 A * 4/2000 Taylor ..... 273/292
6,508,470 B1 * 1/2003 Yuan ..... 273/292
6,746,017 B2 * 6/2004 Yu et al. ..... 273/273
6,769,692 B1 * 8/2004 Cavalluzzo ..... 273/272
7,604,237 B2 * 10/2009 Czekanski ..... 273/309
7,845,641 B2 * 12/2010 Miller et al. ..... 273/292
2006/0237910 A1 * 10/2006 Yu ..... 273/292

* cited by examiner

*Primary Examiner* — Kurt Fernstrom
*Assistant Examiner* — Dolores Collins

(57) ABSTRACT

A method of playing a game that includes a plurality of tiles that are marked with a number, a letter, or a pictorial symbol. Each player aims to replicate a sequence on identical game cards with allocated, swapped, and chosen tiles, using sets within chosen sequence. The method may be implemented by a game kit comprising physical tiles, tile racks, and other physical items. Alternatively the method may be implemented by software and run on a computerized device, which may include a networked computer server and various remote computerized player devices.

14 Claims, 8 Drawing Sheets

TILE TO GAME CARD REPLICATION GAME

CROSS REFERENCE TO RELATED APPLICATIONS

This application claims the priority benefit of U.S. patent application Ser. No. 12/286,405, filed on Sep. 29, 2008, entitled "Tile to game card replication game", Nancy Susan Factor, inventor, the contents of which are incorporated herein by reference.

BACKGROUND OF THE INVENTION

1. Field of the Invention

The invention is in the general field of games and gaming technology, in particular children's games and gaming technology.

2. Description of the Related Art

A historic way for social interaction has been games, usually using set or established rules, which also rely on skill, chance, and competition. Such games are a way for people to have fun, build relationships, strengthen cognitive skills, promote organization and planning, and educate in an unobtrusive way.

Successful games are not easy to develop, however. In order to be successful, the game process or "rules" must be rather precisely tuned as to not to be too easy, and not to be too hard, and to engage the players sufficiently that they continue to find the game to be pleasurable over a sustained period of time. As a result, game design is an unpredictable art, where rules must be tuned, often by a process of trial and error, in order to achieve the necessary balance needed for a game to obtain widespread use.

Once a successful set of game processes or rules has been devised that proves to be popular upon prolonged play use, this set of processes or rules can then be implemented in various formats, including a game kit comprised of various physical game pieces, or alternatively a electronic or computer game in which the various game pieces can, for example, be represented as computer graphics displayed on a computer video screen, and the manipulations can also be done electronically, often on a computer CPU such as a microprocessor, and the rules are implemented in the form of software that is executed by the CPU/microprocessor and in turn manipulates state of the computer system's memory.

BRIEF SUMMARY OF THE INVENTION

The object of the invention is to transform the distribution of a set of real or virtual (computer generated) tiles (gaming pieces) from an initial random distribution to a final quasi-ordered distribution by way of set of gaming processes or gaming rules designed to make the tile transformation process both socially rewarding and pleasurable. Here these various game processes will often be referred to as game rules, and the overall tile distribution transformation processes will often be referred to as the game.

In the invention's a method of playing a game, players race (in a turn-based sequence, where each player has a turn, and one player will complete his or her turn before the turn passes to the next player) to manipulate the player's individual set of tiles. The players individual set of tiles will be obtained by both a mixture of random tile draws, as well as player skill at choosing and discarding tiles. Each player's goal is to manipulate his or her tiles to match one of a number of preferred outcome tile set patterns or goals. These goals will often be presented to the players in the form of a list or menu of alternate preferred outcome or "goal" patterns. This list or menu may be printed on a card, such as a game card, printed on paper, put in a booklet, displayed on a computer screen, or conveyed by any other suitable means. In order to add additional challenge, in some game embodiments, each set within a replicated sequence must be a different color in order for said player to win said game, so that the user's must match color patterns as well as tile face value graphics.

In one embodiment, the invention is a method of playing a game that includes a plurality of tiles that are marked with a number, a letter, or a pictorial symbol of different color.

Each player aims to replicate a sequence on identical game cards with allocated, swapped, and chosen tiles, optionally using multi-color sets within the chosen sequence.

The invention may be implemented by various methods including a set of rules, a game kit of components and rules, or alternatively as software for a computerized system, which may be a networked computerized system, designed for play over a network such as a telephone network, a cell phone network, or the internet.

DETAILED DESCRIPTION OF THE INVENTION

The game is generally intended for 2 to 4 players, ages 6 and up. The game may be either implemented in the form of a game kit of actual physical gaming pieces, or alternatively in the form of software that runs on a computerized device containing at least one microprocessor CPU which implements virtual gaming pieces that are displayed on a computer video or other graphics display screen. In alternative embodiments, the game may be played as a single player computerized device game, or alternatively as a game with more than 4 players in either a computer or physical gaming piece embodiment.

In the computerized form, the computerized device may be a hand-held video game, a cellular phone, a pad based computer, a hand-held computer, a desktop computer, or other such device. In the computerized form, the game may be run either directly on a machine local to the user, or alternatively may be run on a remote computerized server device over a networking system, such as a telephone network or the Internet, and the results transmitted over the network to various computerized devices local to the various players.

Figure 1:
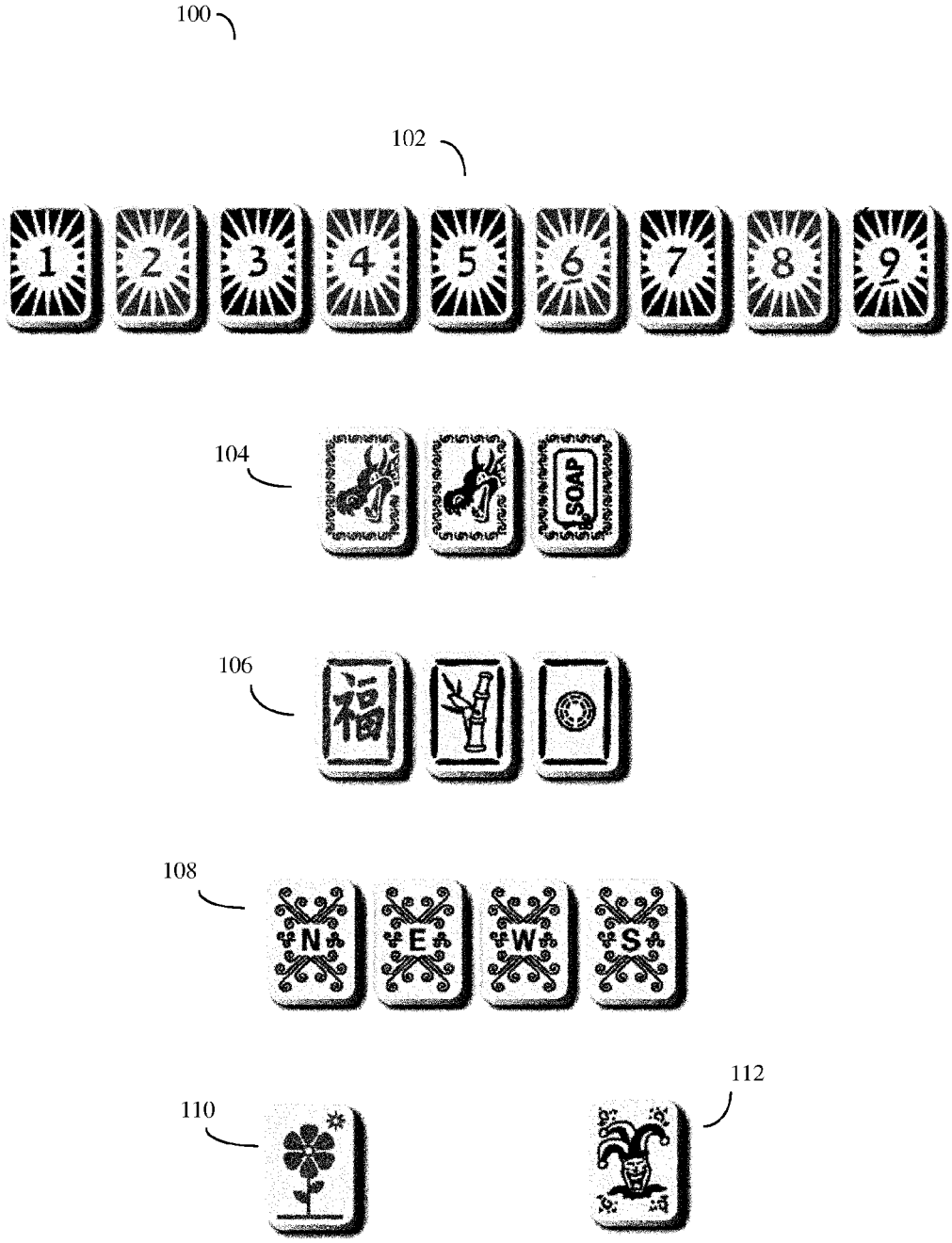
FIG. 1 shows representations of tiles with unique symbols, alpha, numeric, and pictorial.

When implemented in a game kit form, the gaming kit may comprise a limited number of tiles, such as 90 tiles. In one embodiment, shown in FIG. 1, these tiles may comprise number tiles, such as four sets of tiles with the numbers 1 through 9 on each tile (102), thus providing 36 number tiles. The images on the tiles and the gaming kit may reflect various themes, such as a sports theme, an adventure theme, or a theme that mimics the look (but not the rules) of adult games, such as Mahjong or popular card games such as bridge or poker. For example, for a Mahjong graphical theme, the gaming kit may comprise a first set of illustrated tiles, here termed "dragon tiles" (104) which may, for example, comprise four sets of tiles with different logos on them, such as a red dragon, a green dragon, and a bar of soap, thus providing 12 first illustrated tiles. The gaming kit may also comprise a set of second illustrated tiles, here termed "suit tiles" (106), which may for example comprise four sets of tiles with different illustrations on them, such as the Chinese symbols for "Crack", "Bam" and a Chinese "dot" symbol, thus providing 12 second illustrated tiles. The gaming kit may also comprise a set of third illustrated tiles, here termed "wind tiles" (108), and may for example comprise four sets of tiles with a logo indicating different wind directions on them, such as "North", "East", "West" and "South" thus providing sixteen third illustrated tiles. The gaming kit may additionally comprise a set of fourth illustrated tiles; here termed "flower tiles" (110), which may for example comprise a set of six tiles with flower illustrations on them. The gaming kit may additionally comprise a set of fifth illustrated tiles, here termed "joker tiles" (112), which may, for example, comprise a set of eight tiles with a stylized head or figure of a clown or "joker" like illustration. The actual number of each type of tile may vary depending upon the maximum number of players that are intended to be able to play at any one time.

Figure 2:
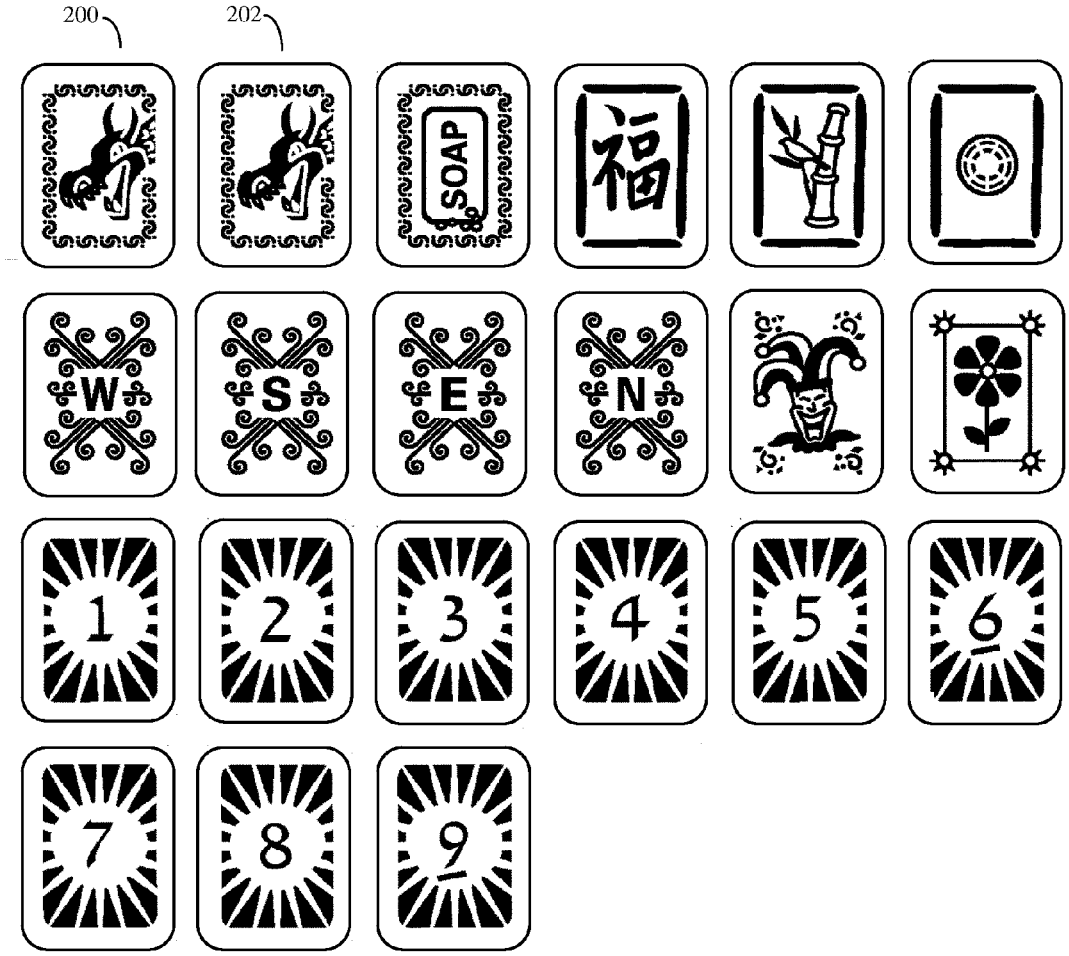
FIG. 2 shows a close-up of the representations of the tiles.

FIG. 2 shows a close up of some of the gaming tiles that may be used, either as physical game pieces, or alternatively as computer graphics, on one embodiment of the game. Note that the game tiles may also have different colors, so that the dragon tile (200) may be green, while the alternate dragon tile (202) may be red.

Figure 4:
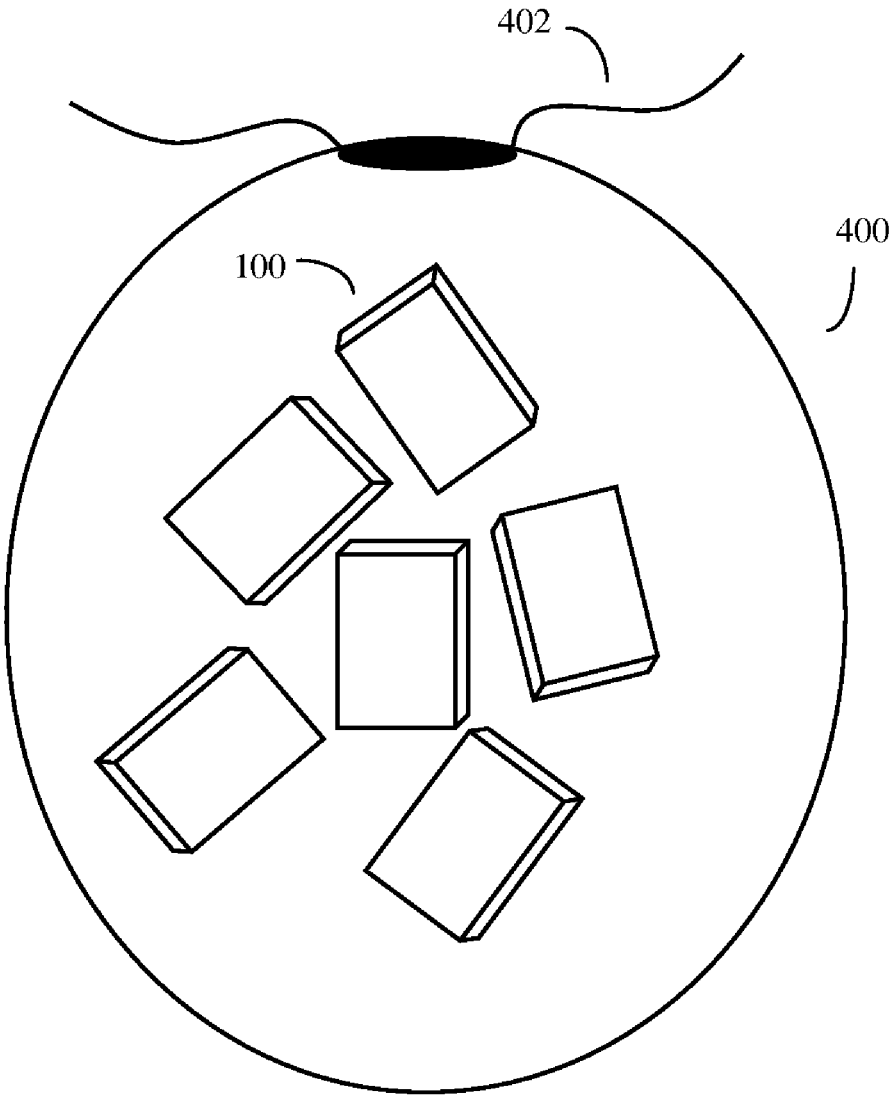
FIG. 4 shows a representation of a tile receptacle (here a drawstring bag) for tile storage, randomization, and picking.
Figure 5:
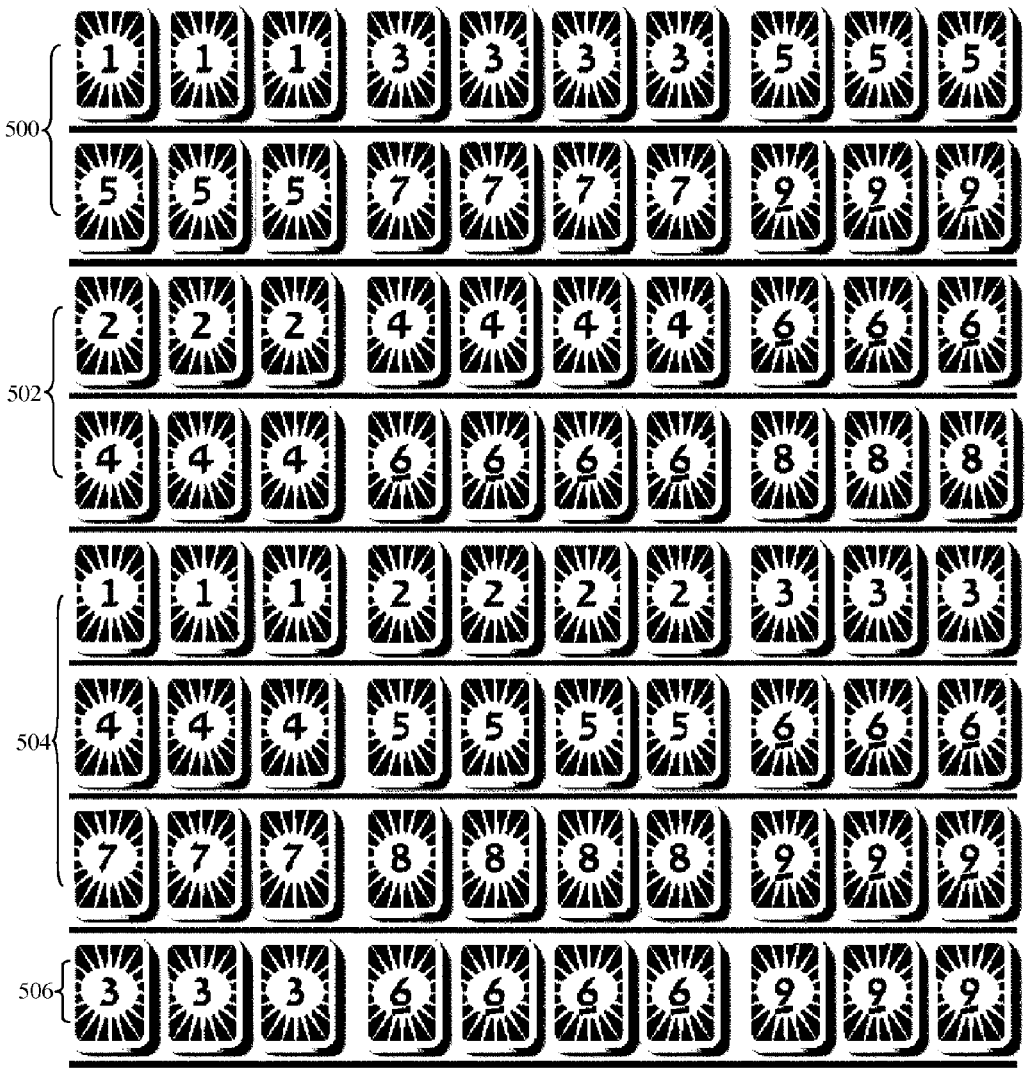
FIG. 5 shows a representation of part of a game card showing a list or menu of preferred outcome tile set patterns or goals. Here the numeric tile goals are shown. The actual tiles may optionally have different colors, such as red and green.
Figure 6:
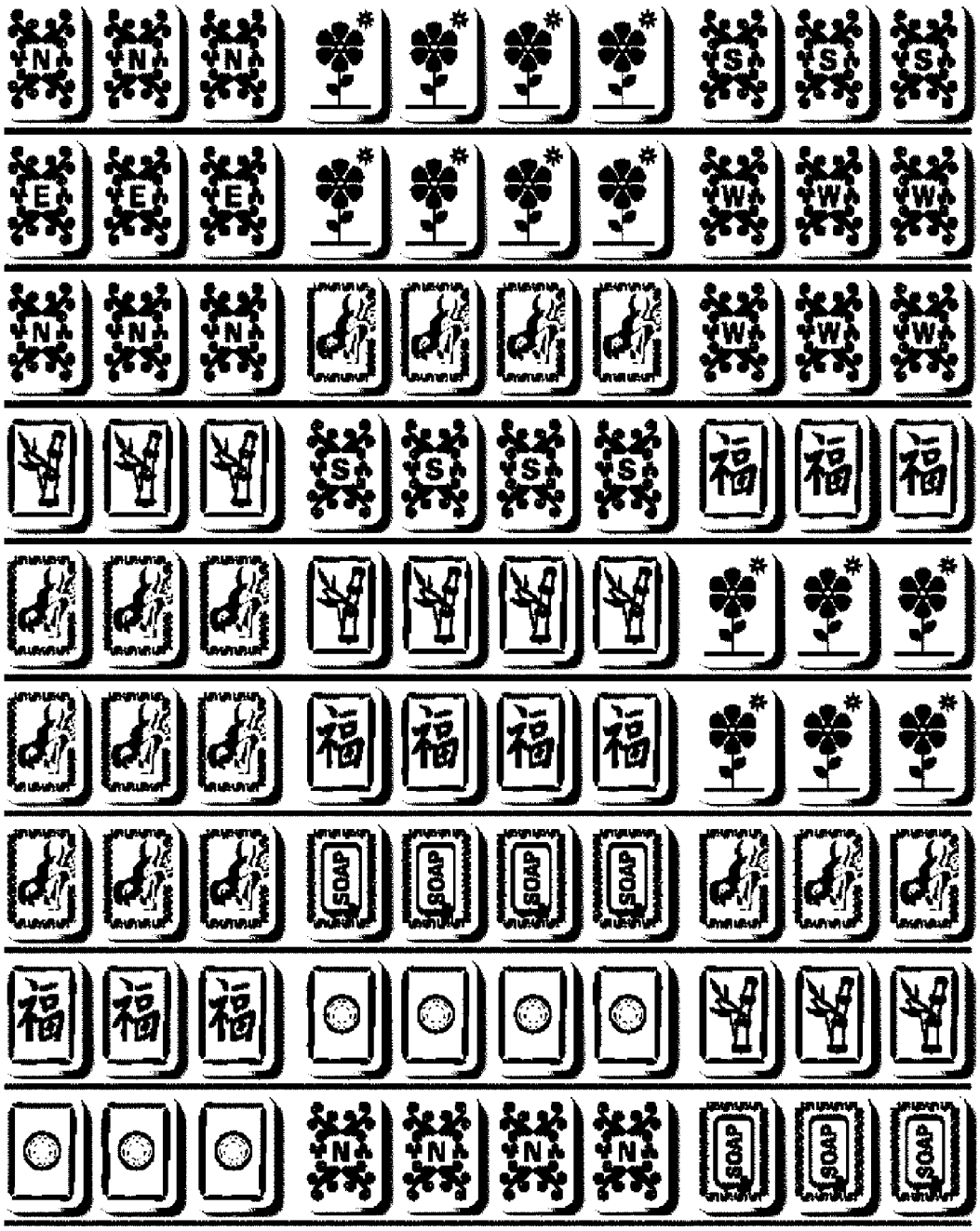
FIG. 6 shows a representation of another part of a game card showing another part of the list or menu of preferred outcome tile set patterns or goals. Here the pictorial pattern tile goals are shown. The actual tiles may optionally have different colors, such as red and green.

In addition to the gaming tiles, the gaming kit may also comprise additional components, such as a set of tile racks (FIG. 3) (e.g. four tile racks), a mechanism for randomizing and distributing the gaming tiles, such as a drawstring bag, cup, or other device (FIG. 4), and a list or menu of preferred outcome tile set patterns or goals, which often may be printed on a card and designated as a "game card". Examples of these goals are shown in FIGS. 5 and 6. FIG. 5 (500) shows the odd number goals, which may be printed in a first distinctive color, and (502) shows the even number goals, which may be printed in a second distinctive color. By contrast, (504) shows a three in a row goal, where the odd numbers may be printed in a first distinctive color, and the even numbers may be printed in a second distinctive color. Finally (506) shows a 3, 6, 9 goal, where again the odd and even numbers may be printed in different distinctive colors. FIG. 6 shows the various winds and dragons suit goals.

Figure 3:
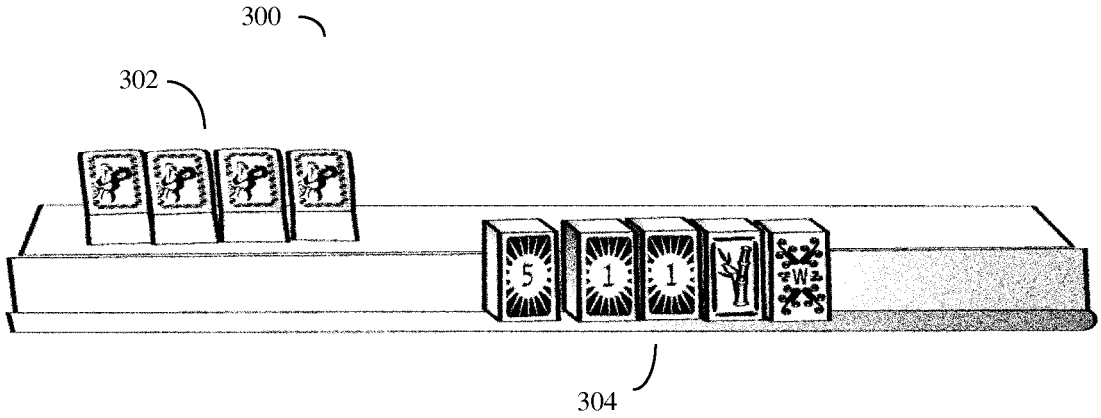
FIG. 3 shows a representation of a tile rack and a number of game tiles.

The tile rack FIG. 3 (300), may optionally be designed so as to accommodate both tiles intended to be publicly displayed to other players (302), as well as to accommodate tiles that are intended to remain hidden from other players (304).

The tiles are initially randomized, and as the game is played, the distribution of the tiles will be transformed from an initial random distribution inside the mechanism for randomizing and distributing the gaming tiles, into a more ordered and non-random state. For example, as FIG. 4 shows, the various game tiles (100) can be placed into a container. Here a draw-string bag (400) is shown, with a draw-string opening (402) and the tile distribution can be randomized by shaking the bag (400). The bag can then be opened and, without looking at the tiles, a player may withdraw one tile from the bag at a time, thus obtaining a randomized tile distribution. Alternatively, in the computerized form of the invention, the electronic tiles may be randomized by a random number generator algorithm.

At the end of the game, the tiles will have been transformed from a series of randomly distributed tiles into a series of more ordered game tiles that may, for example be placed in a non-random distribution on the provided tile racks (FIG. 3, (300)), and additionally may be placed in a non-random distribution on a gaming surface, such as the top of a table. Thus from a physics or statistical perspective, the entropy of the game system tiles are transformed during the course of the game. The randomized tiles represent a higher entropy state, and these tiles are transformed into a lower entropy state by a series of gaming operations as described herein.

The game scheme or "object of the game" for accomplishing this tile transformation will generally be by a process in which the players, either human or computerized, will match the tiles (either real or virtual) that have been assigned to the various tile racks (either real or virtual) to any hand on the game card (either real or virtual).

Figure 7:
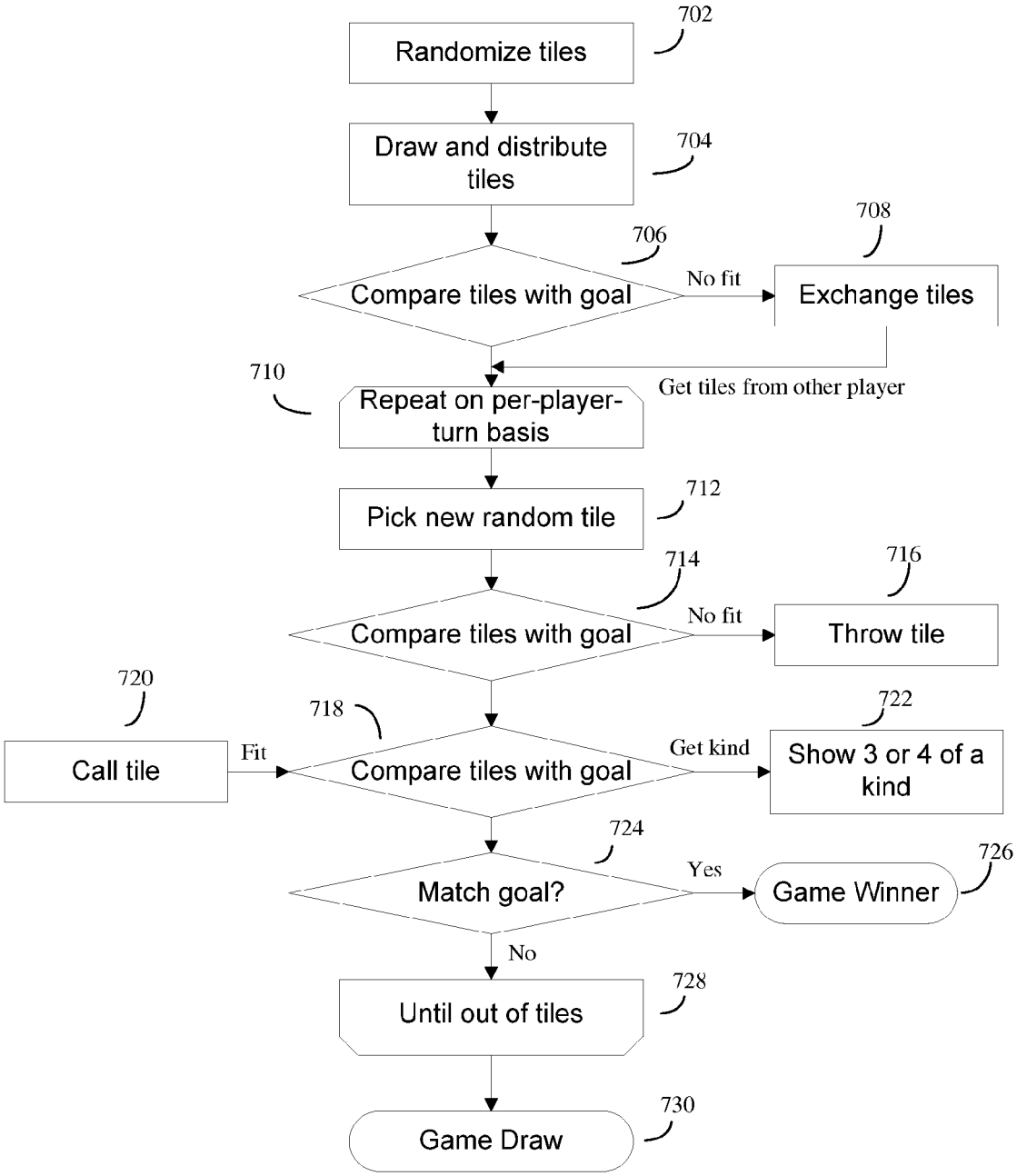
FIG. 7 shows a flow chart of the game.

A flow chart showing the general order of operations or "rules" of the game is shown in FIG. 7. This flow chart may also be used to implement a software version of the game designed to be run on one or more computerized devices.

To begin the game, the tiles, either real or virtual, are randomized (702). As previously discussed, for real (physical) tiles, this can be done by, for example, placing the tiles into a container, such as a bag, shaker, or can, and shaking the container. The tiles can then be withdrawn by hand from the container, or alternatively randomly shaken out one at a time basis, and then placed on the tile racks (704). Usually a limited number of tiles, such as nine tiles per player, will be withdrawn from the container on the initial randomization step, and to ensure that the tiles are randomly selected, if a human user is used to withdraw the tiles, the human user will be expected not to look at and bias the distribution of the tiles as they are randomly withdrawn from the container.

For virtual tiles, as previously discussed, this can be done by randomizing the selection of tiles in computer memory, such as the computer's random access memory, according to one or more standard randomization algorithms. The computer can then distribute these "virtual tiles" into "virtual racks" (FIG. 3, 300) and display the results on a video or other type of display screen. If the game is being run on a remote computer, such as a remote internet computer server, then the results of the randomization process and the virtual tile distribution onto virtual racks can be transmitted over the network, such as the internet, and be displayed on a computerized device local to the user, such as on a web browser running on a personal computer, cell phone, or other device.

After the initial tile randomization and distribution process, each player may optionally sort his or her tiles, placing pairs and triples together, to facilitate pattern recognition and to make it easier to determine how close the player's assortment of tiles (or "hand") is to the desired goal, to be discussed shortly.

The general object of the game is to be the first player to match the tiles on the player's tile rack to any preferred hand (preferred tile distribution outcomes) displayed on the game card or other game instructions for use.

During the course of the game method, after the initial tile randomization and distribution steps, the distribution of the tiles will be further transformed by several different game operations, including tile exchange, tile picking, tile throwing, and tile calling. These tile exchange, tile picking, tile throwing, and tile calling steps will in turn be informed or controlled by various tile distribution goals which will often be displayed on game cards or other instructional devices available to each player.

These different game operations are discussed below.

Tile Exchange:

All players will compare their initial assortment of tiles with the goal (706), determine which tiles, such as three tiles, are likely to be least useful at obtaining the goal, and remove these respective tiles from the user's tile rack to exchange or give away (708). Next, at the same time, all players pass these tiles; face down or with their values otherwise hidden, to either a different player, or in the case of a computerized system, to a computer software module that is simulating a different human player. So any given player will both give away tiles and receive tiles during the exchange process (708).

Usually the pattern of tile distribution will follow a set pattern, such as always passing to the next player on the right of any given player, in a closed or circular like manner so that all players pass tiles and all players receive tiles. This tile exchange may be performed one, or optionally two or more times, depending on the version of the game rules.

The general strategy of algorithm used to determine which tiles to pass is to check the player's particular set of tiles against the various preferred tile sets, or "hands" displayed on the Game Card or other instructional media. A generally good strategy will be to look at the various preferred outcome tile sets or "hands", set this as a preliminary goal, and then exchange tiles that do not appear to be consistent with the referred outcome tile set. A secondary strategy is to try to avoid giving away matched pairs or triples of game tiles, as these may be overly useful to the player receiving the tiles, and thus reduce the chances of achieving the preferred outcome tile set first.

The initial tile exchange will may often be set to take place only once, at the beginning of the game. The subsequent steps below will then usually be repeated a number of times (710), during the course of a game, on a per-player-turn basis, until the reservoir of randomized tiles in the tile randomization device (bag) is exhausted.

Tile Picking

Here a fresh tile is randomly selected from the tile dispensing container (712), and examined by the player (714). If the new tile is needed to allow the distribution of tiles on the player's tile rack to more closely approach the preferred outcome tile set, then the newly selected tile is placed on the tile rack, and a different tile from the tile rack, (normally one that is not required to approach the preferred outcome tile set or goal), will be selected and discarded or "thrown" (716), following throw rules as discussed below. If the newly selected tile does not allow the distribution of tiles on the player's tile rack to more closely approach the preferred outcome tile set, then the newly selected tile may be itself thrown. When this is done in social game situations involving children, often the youngest player may be allowed to pick and throw first.

In a computerized version, a computer software module will do the steps of randomly selecting a fresh tile, and the user may indicate which tile to select or throw by viewing the computer display screen, video screen, and the like, and selecting the appropriate tile by a mouse click, finger motion, verbal command and the like. If a network computerized version is used, multiple players, who may be in entirely different parts of the world, may inform a centralized computer game server of their particular decisions by sending data over a network, such as the internet. Alternatively the computerized computer game server may simulate the play of any missing human players by appropriate software modules.

Tile Throwing:

In one embodiment, generally suitable for a game kit, the tiles may be thrown (716) by placing them in the middle of the common playing surface, such as the playing table. When played in a multi-user social situation, the player may optionally loudly say the name of the tile for all other players to hear.

For example: when a player throws a tile face up in the middle of a gaming table, the player may loudly say the name of that tile such as: "Red Dragon" or "Three" or "Flower", etc.

In one embodiment, the previously thrown tiles that are face up in the middle of the table are no longer in play and may not be picked up by any player. Similarly a computerized game playing system may remove these tiles by making them as inactive in the computer's memory.

Here, the general tile throwing rule or constraint is that the player must always have the predetermined number of tiles, such as nine tiles, including the tiles that are displayed on the front part of your tile rack. In this example, the only time that a player will have 10 tiles is when a player picks or calls the 10th tile to win the game, and no discarding or throwing operation is then needed because the game is over.

In both game kit and computerized versions, players will continue to pick and throw in clockwise order, until the game is won.

Calling a Tile:

If the previous player has just thrown a tile that the currently playing player needs to complete 3 of a kind or 4 of a kind tile matching between the tiles in the tile rack, and the preferred outcome tile set (goal), then the current player may acquire this tile by "calling" the tile (720). Normally the player will only do so if, in the player's judgment, this recently thrown tile will help the player further refine his or her set of tiles to more closely resemble the preferred outcome tile set or "hands" previously selected by the user (718). In the game kit embodiment, after picking up the tile from the table or gaming surface, the player will display the completed three of a kind or four of a kind part of the hand that the player is collecting on, for example, the front part of the player's tile rack as is shown in FIG. 3 (302), faces towards the other players, thus making this information publicly available (722). The player will then typically choose a tile from his or her tile rack to throw, so that the player is again left with only the preset number of tiles, such as nine tiles. In one embodiment of the game rules, the player may call a thrown tile at any time, even if it is not the player's turn.

In a computerized version of the game, much the same procedure will apply. However here the computer system can keep track of the completed three of a kind or four of a kind tile set, and can automatically display these tiles to the other players using a variety of different alternative graphic display schemes. These alternative schemes can include a graphic display of virtual tiles on a virtual tile-rack, such the tile rack as shown in FIG. 4, or an alternative graphic design.

Optical Call Rules

In order to improve the game play experience, the following optional rules or constraints on the tile calling process may be also used.

1) A player may only call a tile which completes a three of a kind or a four of a kind tile set. This player must then display this completed set for all to see.

2) One or more Joker tiles may be used to complete a three of a kind or four of a kind tile set.

3) A player may only call a tile when another player throws the tile. An additional constraint that may be helpful in a game kit context with multiple players is the constraint that the player must also hear the tiles name said out loud by the tile-throwing player.

4) A player may not call a tile that was thrown earlier in the game.

5) If more than one player calls a tile, the player next in turn gets possession of the called tile.

6) Once a player calls and display his or her tiles, they cannot be changed. Player may decide in mid play that the previously selected preferred outcome tile set is no longer appropriate, and instead select a new preferred outcome tile set as the new game goal, however this new preferred outcome tile set must have the same three of a kind or four of a kind matching tile set which the player has previously obtained and displayed on his or her tile rack.

7) A player may only display the three of a kind or four of a kind matched tile set part of the hand that is completed with the called tile. A player may not reveal or display any other completed three of a kind or four of a kind matched tile set from his or her tile rack. This rule is intended to prevent the other players from guessing the player's hand, and therefore confounding the player by avoiding throwing the tiles that the player needs to complete his or her preferred outcome tile set.

AFTER A CALL, the game will generally continue with the next player whose turn is after the player who called the tile.

"Stealing" a Joker:

A player can steal a Joker from the front display part of any tile rack, even his own. To steal a Joker you must replace the Joker with the tile that completes the 3 or 4 of a kind. Tiles to replace the Joker can come from your tile rack or picked from the drawstring bag. You can steal a Joker at the beginning of a turn or after you pick from the drawstring bag, but NOT after you throw a tile.

Winning the Game:

Players pick, throw, and call tiles until a player's tiles exactly match a hand on the Game Card (724). When this happens, that player is declared the winner of the game (726).

Otherwise the game continues and repeats until the supply of randomized tiles in the tile dispenser is exhausted (728). If this occurs and no player has previously won, then the game is declared a draw (730).

Alternatively, the game may be considered to be a method of playing a game whereby players pick, discard, and swap tiles, in attempt to be the first player whose hand replicates a sequence on identical game cards using multi-colors. This method will generally comprise the steps of (when said game is played with two or more players), picking a designated number of tiles, and performing a tile exchange operation by exchanging 3 unwanted tiles with another corresponding player (such as the next player in the position of game flow), until a complete exchange cycle is completed. Next the tiles are picked and discarded in clockwise order with opportunity for players to call needed tiles to complete sets within the sequence. In the game rules, jokers may be wild and can be used to represent any tile symbol, and may be claimed by any player who has the tile of said Joker's assigned symbol. The game will continues until any player's hand matches a sequence on the game card, and optionally each set within the replicated sequence is a different color. If the tile randomization device or tile receptacle is empty then the game is considered to be a draw. Here all players will use the identical set of game cards to play the game.

Other variations of the game design and game parts are possible, and are included in the general game method. For example, additional number of game cards with new goal sequences may be provided. An additional or alternate number of game tiles may also change. The tile colors may also be changed. The tile numbers, letters, and pictorial symbols may also change. The tile racks, tiles, and tile receptacle(s) may be made of any material and may vary in color, size, shape and design. As previously discussed, a computer software version following the same or similar game rules, and typically running on a microprocessor or other type of computer CPU may also be provided.

Other Embodiments

Additional embodiments can be added to both add an additional air of unpredictability to the game, as well as to add additional time pressure to the game.

The various players will have at least partial knowledge of the contents of the other player's tile racks, both because some of the tiles will be made public as a result of the call tile procedure and 3 or 4 of a kind matching, and because players can also take note of which tiles are being discarded or thrown by other players. Thus more skilled players will start to create a strategy that anticipates other player's moves to some extent.

Figure 8:
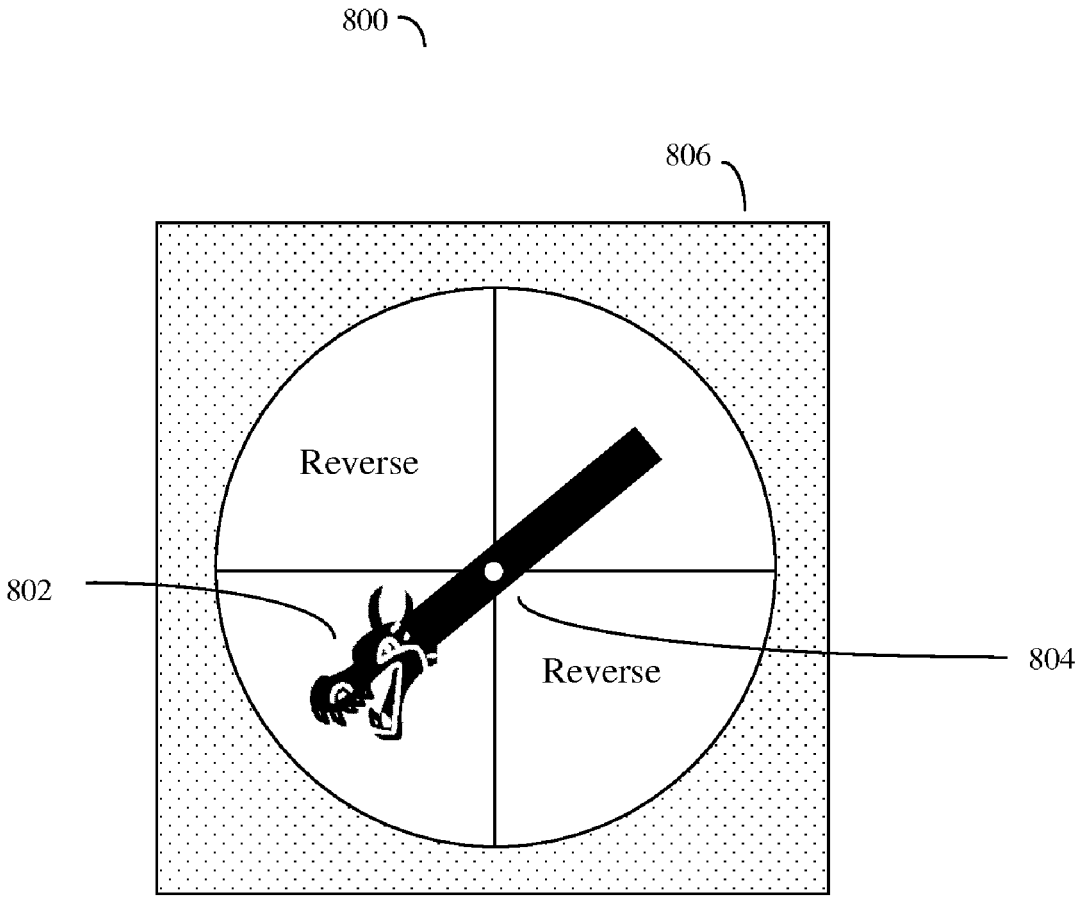
FIG. 8 shows a dragon head spinner device.

To increase unpredictability, which will to some extent even up the skill differences between young or inexperienced players and adult or skilled players, a random spinner device may be added to the game. This is shown in FIG. 8. For example, after every player has had a turn, the spinner may be spun, and the direction of the game changed. As another example, the spinner may randomly direct users to add extra tiles to the game, skip a turn, take two turns and so on. To add extra interest, this spinner device (800) could have a spinner pointer in the shape of a dragon head spinner (802) mounted on a pivot (804) above a base with various game options (806).

To add additional time pressure, a sand timer or kitchen timer could be used, either on a per turn basis, a per multiple-player turn basis, or even on a per game basis. This timer could be used to count down to when the game will reverse direction, or alternatively count down to the end of the game.

Dice, including customized dice, (for example, dice with dragon logos or dragon shapes) might also be added to increase the unpredictability of the game. These dice could be in non-standard dice shapes in addition to the standard platonic solids, such as catalan solids, di-pyramids, trapezohedra, prisms, modified prisms (odd), modified prisms (even), anti-prisms, spheres and other shapes. More specifically the dice can be selected from the group consisting of Triagonal Trapezohedron, Hexahedron D6, Pentagonal Trapezohedron D10, Heptagonal Trapezohedron D14, Tridecagongonal Trapezohedron D26, Heptadecagonal Trapezohedron D34, Icosikaipentagonal Trapezohedron D50, Triangular Prism D5, Square Prism D6, Pentagonal Prism D7, 2-Antiprism D4, 3-Antiprism D8, Sphere, Spherical D4, Spherical Flattened D6, Spherical Flattened D8, Spherical Flattened D32, Spherical Flattened D50, Spherical Flattened D100, and other shapes.

The dice value could, for example, be used to change game direction, allow a free (extra) tile pick, force a random tile replacement in a player's tile rack, or otherwise add other random elements that will again tend to even out skill differences between players.

Supplemental game packs may also be made available. For example, challenge game cards with additional rules, including pairs, may also be sold or provided to increase the complexity of the play and keep the game interesting for more experienced players.

Such challenge hands, for example, may have rules. For example, here the rules may be that a player cannot call for the pair part of the hand, and/or a player cannot use a Joker for the pair part of the hand, and/or a player cannot call a Joker that was thrown. Many other variations on game play will also be within the general spirit of the invention.

The invention claimed is:

1. A computerized multi-player gaming method of transforming a set of virtual game tiles from a randomized state to at least a partially ordered state, said partially ordered state at least partially determined by a predetermined menu of tile distribution outcomes; said method comprising:

obtaining a set of virtual game tiles, said virtual game tile set comprising a plurality of number tiles, a plurality of first illustrated tiles, a plurality of second illustrated tiles, a plurality of third illustrated tiles, a plurality of fourth illustrated tiles, a plurality of fifth illustrated tiles, and a plurality of joker illustrated tiles;

randomizing said set of virtual game tiles and randomly distributing said virtual game tiles to different players, so that each player obtains the same number of tiles and at least some tiles remain unassigned after said random distribution process;

determining, on a per player basis, one or more tile distribution outcome from said predetermined menu of tile distribution outcomes that appear to be most compatible with the player's initial random assortment of tiles;

manipulating said tiles on a per player turn basis, through a series of steps selected from the group consisting of tile exchange, tile picking, tile throwing, tile and tile calling steps;

wherein the first player to obtain a tile distribution that matches a tile distribution on said menu of tile distributions is declared a winner; and wherein if the set of unassigned tiles is exhausted before any player obtains a tile distribution that matches a tile distribution on said menu of tile distributions, then the game is declared a draw; and wherein said method is implemented by at least one microprocessor.

2. The method of claim 1, wherein said tile exchange steps comprises, for each player, picking between two and four tiles assigned to said player by choosing those tiles that are less compatible with a list or menu of outcome tile sets and passing said chosen tiles to another player in a manner that hides the nature or value of the tile from other players.

3. The method of claim 1, wherein said tile picking steps comprises randomly picking an unassigned tile; and determining if said randomly picked tile improves the chances that the player's currently available hand of tiles can be subsequently altered to match at least one outcome tile set on a list or menu of outcome tile sets, and if so keeping said randomly picked tile, and if not, discarding said randomly picked tile.

4. The method of claim 3, wherein said tile is discarded by the steps of placing said discarded tile on a common playing surface so that the value of the tile is visible to all players, and wherein a subsequent player removed from the discarding player by more than one intermediate player may not retrieve or use said discarded tile.

5. The method of claim 4, wherein said discarded tile may be retrieved by the steps of;

for the next subsequent player after said discarding player has discarded said tile, determining if said discarded tile improves the chances that the player's currently available hand of tiles can be subsequently altered to match at least one outcome tile set on a list or menu of outcome tile sets, and if so retrieving said discarded tile; and if said retrieved tile allows said subsequent player to complete a three of a kind or four of a kind tile matching process when combined with said subsequent players existing set of tiles, then making the existence of said three of a kind or four of a kind set of matched tiles available to other players.

6. The method of claim 1, wherein said virtual game tiles comprises further comprising tiles necessary to complement sequences for game play.

7. The method of claim 6, wherein said virtual game tiles comprises 36 number tiles, said plurality of first illustrated tiles comprises twelve dragon tiles, said plurality of second illustrated tiles comprises nine suit tiles, a said plurality of third illustrated tiles comprises sixteen wind tiles, said plurality of fourth illustrated tiles comprises six flower tiles, and said plurality of fifth illustrated tiles comprises eight joker tiles.

8. The method of claim 7, further comprising a plurality of virtual tile racks, a plurality of virtual game cards, each containing a list or menu of tile distribution outcomes, and a virtual device for randomizing tiles.

9. The method of claim 8, wherein the virtual device for randomizing tiles comprises at least one microprocessor.

10. The method of claim 1, wherein said computerized device is selected from the group consisting of cellular phones, handheld video game devices, pad computers, handheld computers, portable computers and desktop computers.

11. The method of claim 1, wherein said computerized device is a networked computer server, and said players interact with said networked computer server by way of network connections and web browsers.

12. The method of claim 1, further graphically displaying images of virtual tiles and virtual tile racks on one or more computer display screens.

13. The method of claim 1, wherein said joker illustrated tiles are wild and can be used to represent any tile symbol.

14. The method of claim 1, wherein a player can steal another player's joker illustrated tile.

* * * * *